US008506395B2

(12) United States Patent
Bytnar et al.

(10) Patent No.: US 8,506,395 B2
(45) Date of Patent: Aug. 13, 2013

(54) COMMUNICATING WAGERING GAME INFORMATION USING MESH NETWORKS

(75) Inventors: Michael R. Bytnar, Naperville, IL (US); Steven J. Lee, Naperville, IL (US); Nevin J. Liber, Libertyville, IL (US); Jason A. Smith, Vernon Hills, IL (US)

(73) Assignee: WMS Gaming, Inc., Waukegan, IL (US)

( * ) Notice: Subject to any disclaimer, the term of this patent is extended or adjusted under 35 U.S.C. 154(b) by 188 days.

(21) Appl. No.: 13/054,517

(22) PCT Filed: Jul. 16, 2009

(86) PCT No.: PCT/US2009/050906

§ 371 (c)(1),
(2), (4) Date: Jan. 17, 2011

(87) PCT Pub. No.: WO2010/009349

PCT Pub. Date: Jan. 21, 2010

(65) Prior Publication Data

US 2011/0130197 A1 Jun. 2, 2011

Related U.S. Application Data

(60) Provisional application No. 61/081,932, filed on Jul. 18, 2008.

(51) Int. Cl.
*G07F 17/32* (2006.01)

(52) U.S. Cl.
USPC ..... 463/29; 463/16; 463/20; 463/25; 463/42

(58) Field of Classification Search
USPC ..... 463/16–20, 25–29, 42
See application file for complete search history.

(56) References Cited

U.S. PATENT DOCUMENTS

| | | | | |
|---|---|---|---|---|
| 7,040,987 | B2 * | 5/2006 | Walker et al. | 463/42 |
| 2001/0046891 | A1 | 11/2001 | Acres | |
| 2006/0148560 | A1 * | 7/2006 | Arezina et al. | 463/29 |
| 2007/0042823 | A1 | 2/2007 | Shim | |
| 2007/0293293 | A1 | 12/2007 | Baerlocher et al. | |
| 2008/0076572 | A1 | 3/2008 | Nguyen et al. | |

FOREIGN PATENT DOCUMENTS

| | | |
|---|---|---|
| WO | WO2007011718 | 1/2007 |
| WO | WO2010009349 | 2/2010 |

OTHER PUBLICATIONS

"PCT Application No. PCT/US09/50906 International Preliminary Report on Patentability", Feb. 23, 2012 , 4 pages.
"Mesh Networking", Wikipedia http://en.wikipedia.org/wiki/Mesh_networking (Date Obtained from the Internet: Apr. 10, 2008) Last Date Modified: Apr. 9, 2008 , 3 pages.
"Mobile ad-hoc network", Wikipedia http://en.wikipedia.org/wiki/Mobile_ad-hoc_network (Date Obtained from the Internet: Apr. 10, 2008) Last Date Modified: Apr. 4, 2008, 3 pages.
"PCT Application No. PCT/US09/50906 International Search Report", Nov. 2, 2009, 16 pages.

* cited by examiner

*Primary Examiner* — Omkar Deodhar
(74) *Attorney, Agent, or Firm* — DeLizio Gilliam, PLLC

(57) ABSTRACT

A mesh communications wagering game system and its operations are described herein. In some embodiments, the operations can include tracking any number of wireless mesh network devices in relation to a wagering boundary so that the system can manage wagering games. In some embodiments, the operation can include incentivizing players to encourage other players to participate in a mesh network, thus increasing the efficiency of the mesh network. In some embodiments, the operations can include coordinating the presentation of wagering game content between mesh enabled devices.

26 Claims, 9 Drawing Sheets

COMMUNICATING WAGERING GAME INFORMATION USING MESH NETWORKS

RELATED APPLICATIONS

This application claims the priority benefit of U.S. Provisional Application Ser. No. 61/081,932 filed Jul. 18, 2008.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2009, WMS Gaming, Inc.

TECHNICAL FIELD

Embodiments of the inventive subject matter relate generally to wagering game systems, and more particularly to devices and processes that communicate wagering game information in wagering game networks.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

SUMMARY

In some embodiments, a method comprises determining a location and direction of movement of one or more mobile wagering game machines in relation to a wagering game boundary in a casino; determining one or more player accounts associated with the one or more mobile wagering game machines that are configured to receive wagering game content available on an upcoming data broadcast on a casino mesh network; determining, based on the location and direction of movement of the one or more mobile wagering game machines, that the one or more mobile wagering game machines will be within the wagering game boundary during the casino mesh network data broadcast; and determining configurations for the wagering game content based on the location and direction of movement of the one or more mobile wagering game machines.

In some embodiments, the method further comprises determining that the one or more wagering game machines are located outside of the wagering game boundary; determining that the one or more wagering game machines are approaching the wagering game boundary; and transferring the wagering game content, via one or more peer devices in the casino mesh network, to the one or more wagering game machines as the one or more wagering game machines approach the wagering game boundary.

In some embodiments, determining that the one or more player accounts are configured to receive the wagering game content includes accessing player preferences for the one or more player accounts that indicate a desire to receive the wagering game content.

In some embodiments, the method further comprises sending a notification message to the one or more wagering game machines, via the casino mesh network, the notification message indicating that the data broadcast will occur in a specified amount of time; and determining acknowledgement by the one or more wagering game machines of the notification message.

In some embodiments, determining configurations for the wagering game content comprises one or more of preparing the one or more mobile wagering game machines with wagering game assets, determining odds for a community wagering game based on a population of the one or more wagering game machines, preparing a data broadcast schedule that identifies the one or more wagering game machines to receive the wagering game content first in time, and determining wagering game settings for a group wagering game.

In some embodiments, determining a location and direction of movement of the one or more mobile wagering game machines comprises querying a mesh network device to communicate between mesh network peers until receiving location information from the one or more mobile wagering game.

In some embodiments, the method further comprises determining that the one or more mobile wagering game machines are outside of the wagering game boundary; determining that the one or more mobile wagering game machines will not return to the wagering game boundary for the data broadcast; and sending commands to the mesh network peers to operate in one or more of a secure mode, a power saving mode, a maintenance mode, and a non-wagering game mode.

In some embodiments, one or more machine-readable media having instructions stored thereon, which when executed by a set of one or more processors causes the set of one or more processors to perform operations comprises determining a number of user accounts a wagering game player account has recruited to access a casino mesh network; providing one or more recruitment rewards to the wagering game player account based on the number of user accounts recruited; and presenting one or more indicators showing the effects on the casino mesh network caused by the number of user accounts that are recruited.

In some embodiments, the operation for determining the number of user accounts includes operations further comprising presenting a user interface wherein the wagering game player account can select one or more social contact user accounts and one or more wagering games available on the casino mesh network; sending an invitation message from the wagering game player account to the one or more social contact user accounts to play the one or more wagering games available on the casino mesh network; and determining an amount of social contact user accounts that accept the invitation to play the one or more wagering games.

In some embodiments, the operation for presenting a user interface includes operations further comprising including a player sponsored incentive by the wagering game player account to the one or more social contact user accounts; determining that the one or more player accounts accepts the invitation message; and crediting the player sponsored incentive to the one or more social contact user accounts.

In some embodiments, the operation for providing one or more recruitment rewards to the wagering game player account includes operations further comprising determining a value for the one or more recruitment rewards; and modifying the value based on one or more of an amount of time that the one or more wagering games has been available and a game play history for the one or more social contact user accounts indicating whether the one or more social contact user accounts have previously played the one or more wagering games.

In some embodiments, the operation for presenting one or more indicators showing the effects on the casino mesh network, includes operations further comprising indicating an increase in one or more of game access efficiency, potential awards, network speeds, and efficiency of distribution of awards.

In some embodiments, the machine-readable media, the operations further comprises presenting one or more goal markers on a mesh network activity indicator; determining one or more settings for the one or more goal markers by the wagering game player account; determining a value for the one or more recruitment rewards based on the one or more settings; and crediting the one or more recruitment rewards to the wagering game player account when the mesh network activity indicator indicates that the one or more settings have been achieved.

In some embodiments, a system comprises a mobile wagering game machine comprising a mesh network communications unit configured to determine location information for the mobile wagering game machine in relation to a wagering boundary within a casino, and communicate the location information via one or more peer mesh devices in a casino mesh network; and a wagering game server configured to provide wagering game content for a casino mesh network, the wagering game server includes a mesh device tracking unit configured to receive the location information from the mobile wagering game via the casino mesh network, determine one or more player account preferences indicating a desire to receive wagering game content available in a mesh network data broadcast, and determine, based on the location information, that the mobile wagering game machine will be within the wagering game boundary during the casino mesh network data broadcast.

In some embodiments, the system further comprises an account server configured to store the one or more player account preferences, and wherein the mobile wagering game machine is further configured to present a user interface with settings that indicate to notify the player when the wagering game content is available to access.

In some embodiments, the wagering game server further includes an incentives manager configured to provide one or more rewards to one or more wagering game player accounts that recruit wagering game players to utilize the one or more peer mesh devices in the casino mesh network.

In some embodiments, the wagering game server is configured to provide wagering game content for a community wagering game, and wherein the mobile wagering game machine further comprises a presentations coordinator configured to coordinate the presentation of the wagering game content on the mobile wagering game machine and on the one or more peer mesh devices so that the mobile wagering game machine and the one or more peer mesh devices have a synchronized display of the community wagering game.

In some embodiments, an apparatus comprises a content controller configured to receive wagering game content and coordination data from a wagering game server; a content store configured to store the wagering game content and the coordination data; a mesh network communication unit configured to determine that one or more wagering game machines, enabled for mesh network communications, are requesting the wagering game content, and transfer the wagering game content wirelessly to the one or more wagering game machines; and a presentation coordinator configured to synchronize the presentation of the wagering game content on the one or more wagering game machines according to the coordination data.

In some embodiments, the wagering game content is for a community wagering game, wherein a plurality of wagering game machines, in wireless range, are playing the community wagering game, and wherein the presentation coordinator is further configured to synchronize the presentation of the wagering game content on the plurality of wagering game machines so that the wagering game content appears on the wagering game machines at approximately the same time.

In some embodiments, the presentation coordinator is further configured to present secondary wagering game content in a serialized order on the plurality of wagering game machines.

In some embodiments, the mesh network communication unit is further configured to transfer non-wagering game content indicated by a player account associated with the one or more wagering game machines, and wherein the presentations coordinator is configured to coordinate the presentation of the non-wagering game content at the same time as the wagering game content.

In some embodiments, the mesh network communication unit is further configured to determine that the one or more wagering game machines are associated with a player account preference indicating a desire to receive the wagering game content, and transfer the wagering game content to the one or more wagering game machines before transferring the wagering game content to other wagering game machines that are not associated with the player account preference.

In some embodiments, an apparatus, comprises means for sending an invitation message from a wagering game player account to a social contact user account, the invitation message includes an invitation to play a wagering game provided by a wagering game provider that hosts a casino mesh network; means for detecting access by the social contact user account to a device that is configured to access the casino mesh network; and means for crediting one or more recruitment rewards to the wagering game player account.

In some embodiments, the means for detecting access by the social contact user account includes means for indicating the wagering game player account as a recruiter account that should receive the one or more recruitment awards.

In some embodiments, the wagering game machine further comprises means for presenting one or more indicators indicating an increase in one or more of game access efficiency, potential awards, network speeds, and efficiency of distribution of awards caused by access from the social contact user account to the device.

BRIEF DESCRIPTION OF THE DRAWING(S)

Embodiments are illustrated in the Figures of the accompanying drawings in which.

DESCRIPTION OF ILLUSTRATIVE EMBODIMENTS

This description of the embodiments is divided into six sections. The first section provides an introduction to embodiments. The second section describes example operating environments while the third section describes example operations performed by some embodiments. The fourth section describes additional example embodiments while the fifth section describes additional example operating environments. The sixth section presents some general comments.

Introduction

This section provides an introduction to some embodiments.

Casinos utilize many types of gaming devices including standing wagering game machines, mobile machines, bar-top devices, docking stations etc. Wagering game players who use the gaming devices, however, often expect all the gaming devices to be equally equipped with the software and information needed to provide a consistent gaming experience. Casinos, however, are faced with challenges trying to meet the expectations of the wagering game players using a limited casino network bandwidth. For example, different gaming devices may be restricted in their network access capabilities, may require different frequencies of software updates to ensure that the device software is working properly, may have variant locations both within and outside of a casino floor, may experience occasional network congestion, may have to compete with other wagering devices for server download bandwidth and/or download caps, etc.

The inventive subject matter, however, includes embodiments for assisting wagering game devices to communicate and coordinate wagering game information using a casino mesh network ("mesh network"). In the mesh network, wagering devices (e.g., client devices) within the casino's communications network can wirelessly communicate information to each other, forming a "mesh" of wireless peers. In some embodiments, the mesh network can utilize communications controllers and servers to provide and disseminate content that the wagering devices can propagate through the wireless mesh. The wagering devices can pass data along to nearby neighbors using low-powered wireless signals. The data can "hop" from peer to peer until reaching a destination and/or until expiring on the network.

Figure 2:
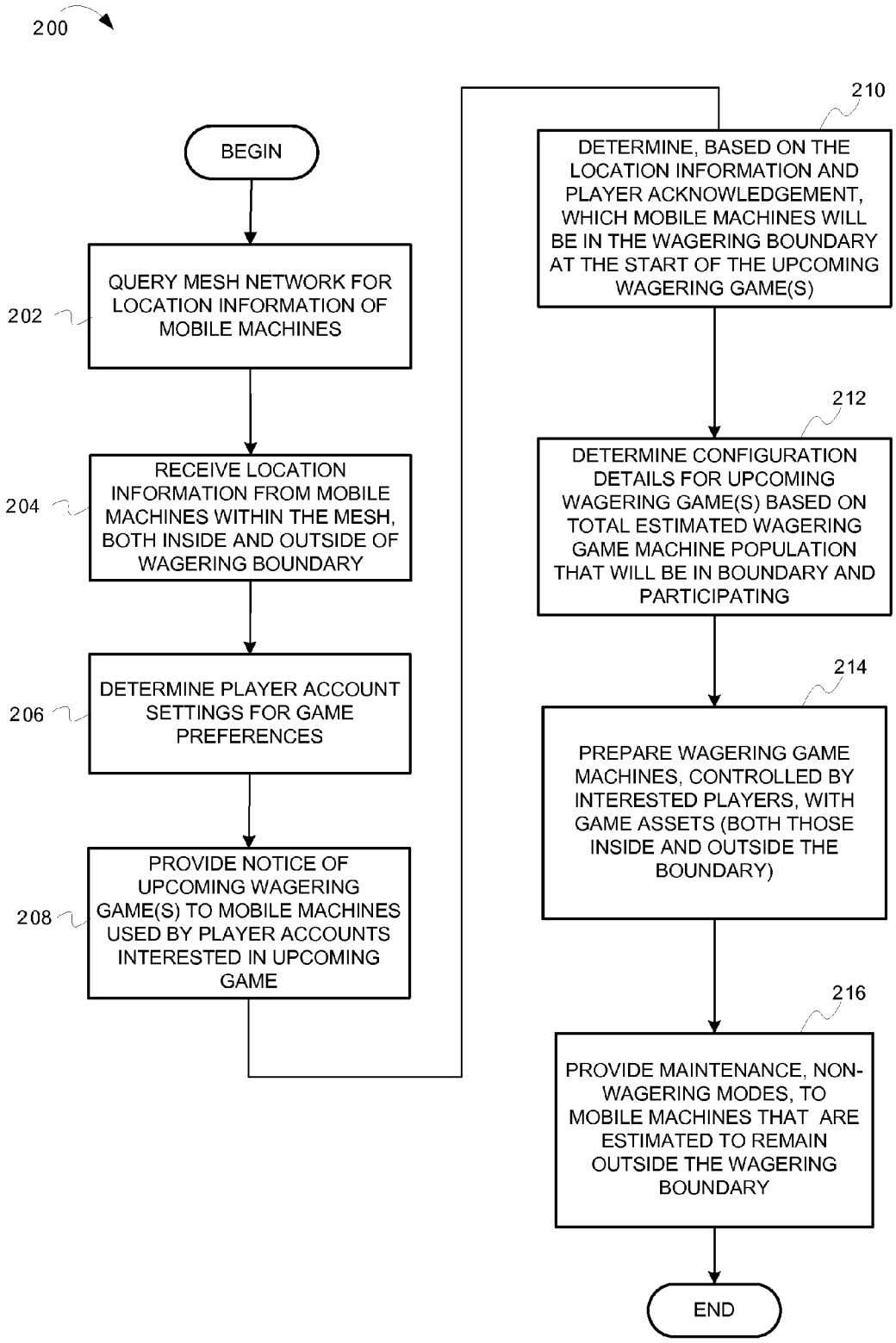
FIG. 2 is a flow diagram 200 illustrating tracking wagering game devices inside and outside a wagering boundary using a mesh network, according to some embodiments.
Figure 3:
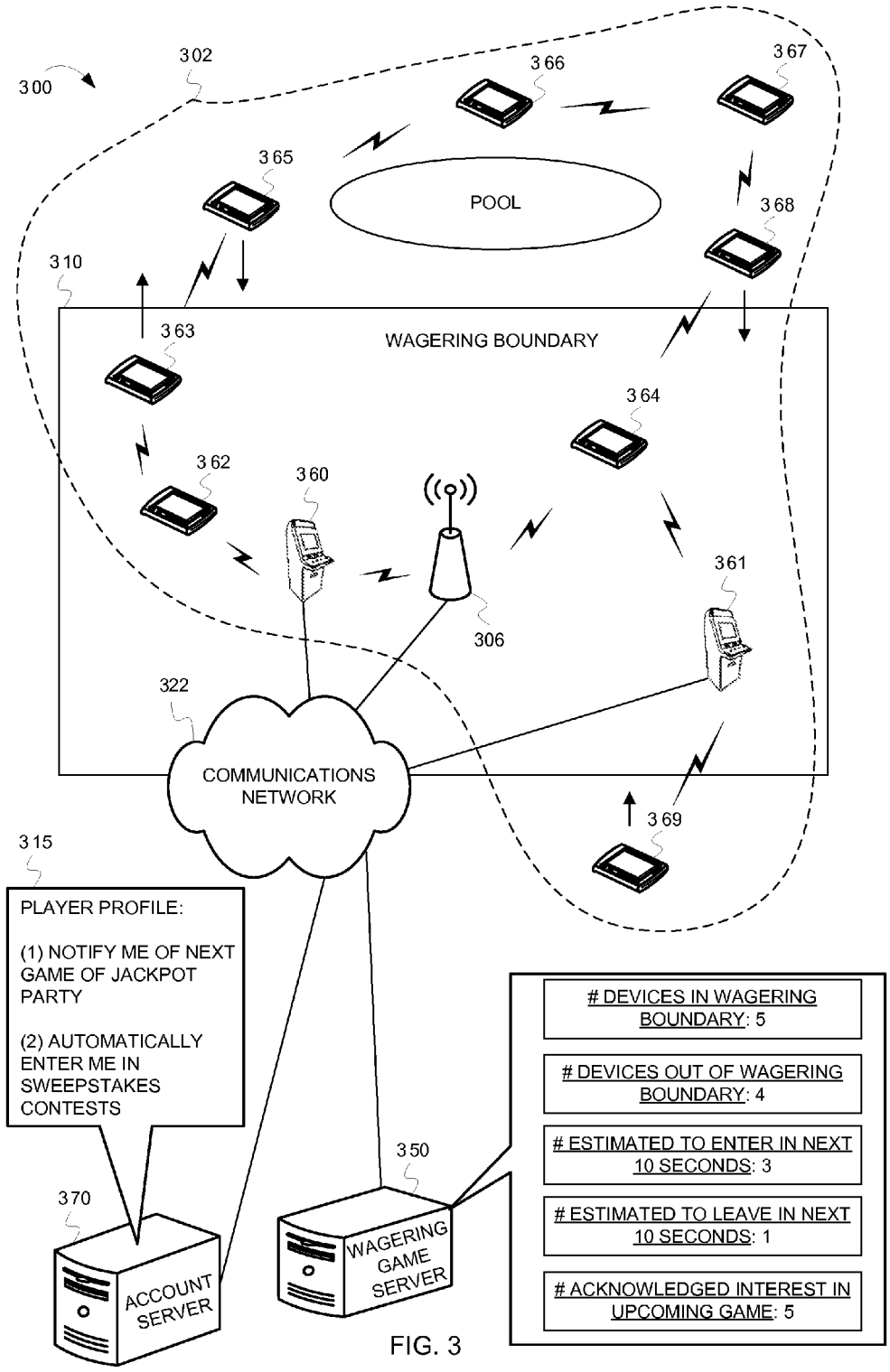
FIG. 3 is an illustration of tracking wagering game devices inside and outside a wagering boundary using a mesh network, according to some embodiments.
Figure 4:
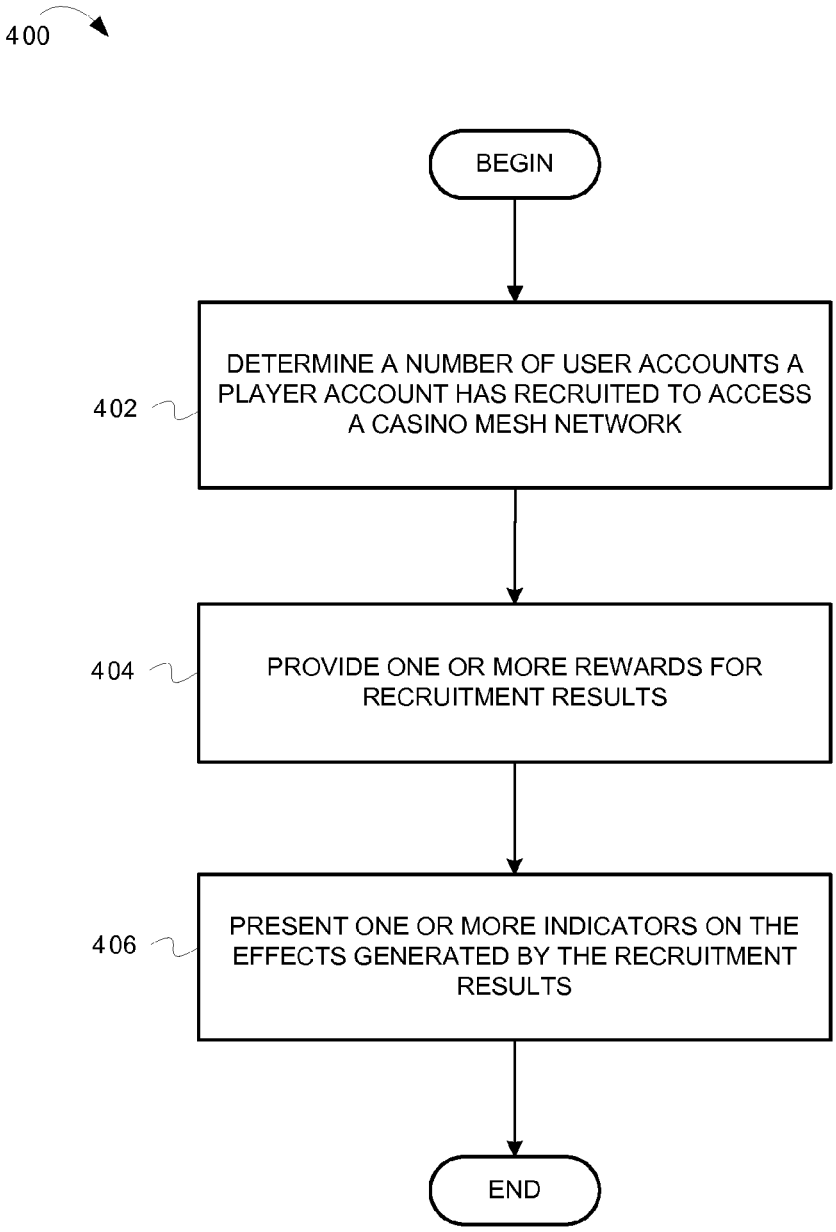
FIG. 4 is a flow diagram 400 illustrating incentivizing wagering game player accounts to utilize a mesh network, according to some embodiments.
Figure 5:
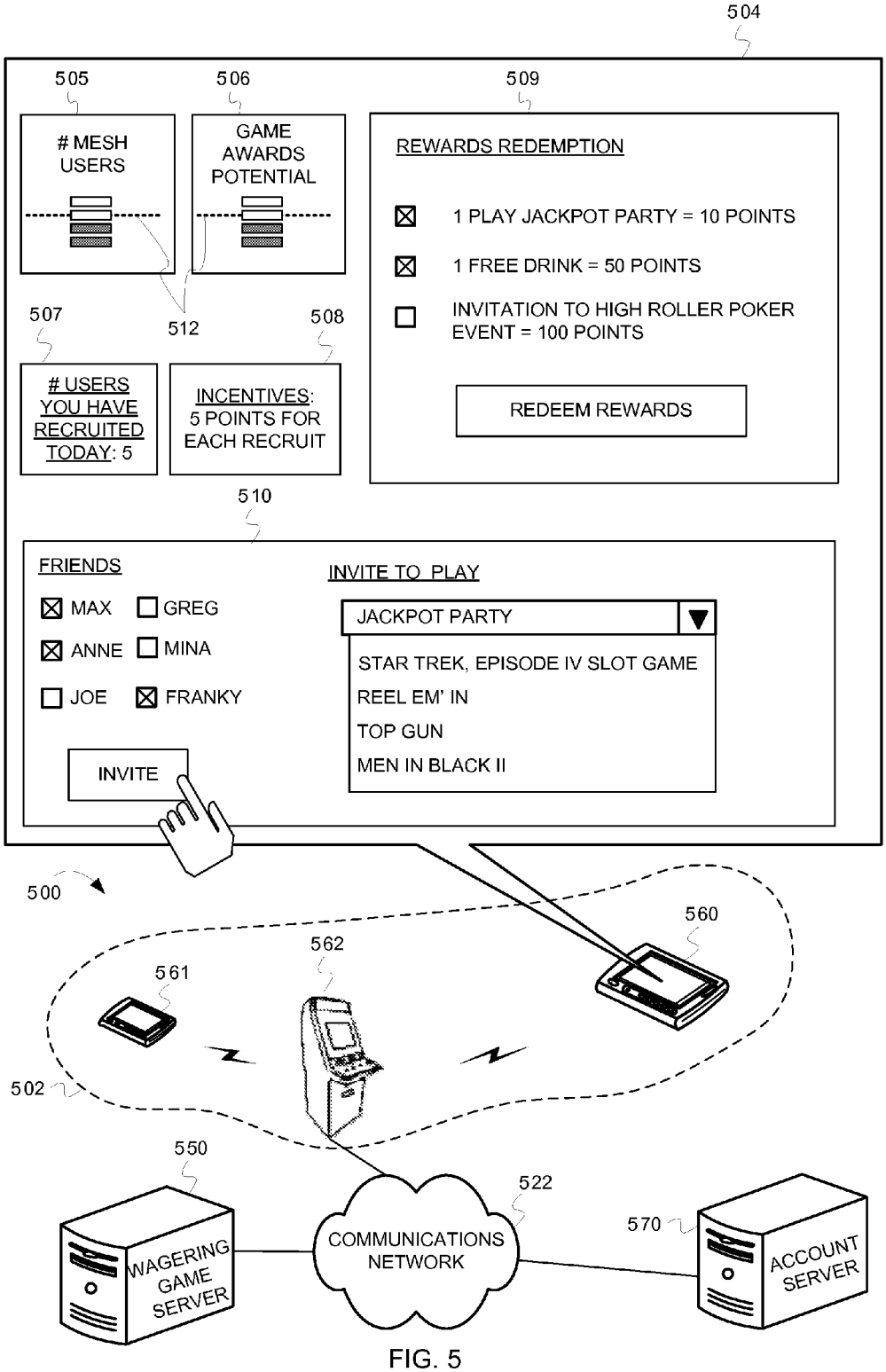
FIG. 5 is an illustration of incentivizing wagering game player accounts to utilize a mesh network, according to some embodiments.
Figure 6:
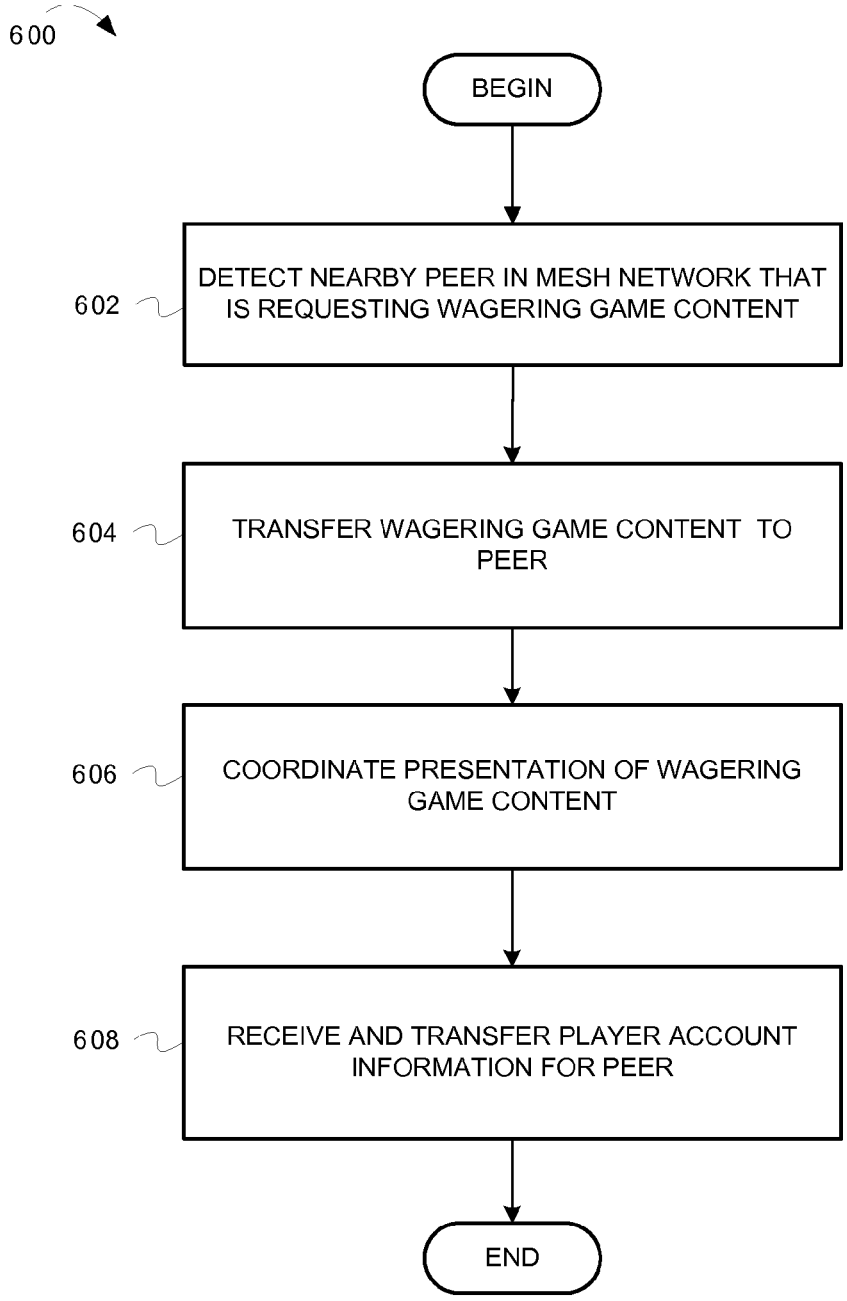
FIG. 6 is a flow diagram 600 illustrating coordinating wagering game content and network communications via a casino mesh network, according to some embodiments.
Figure 7:
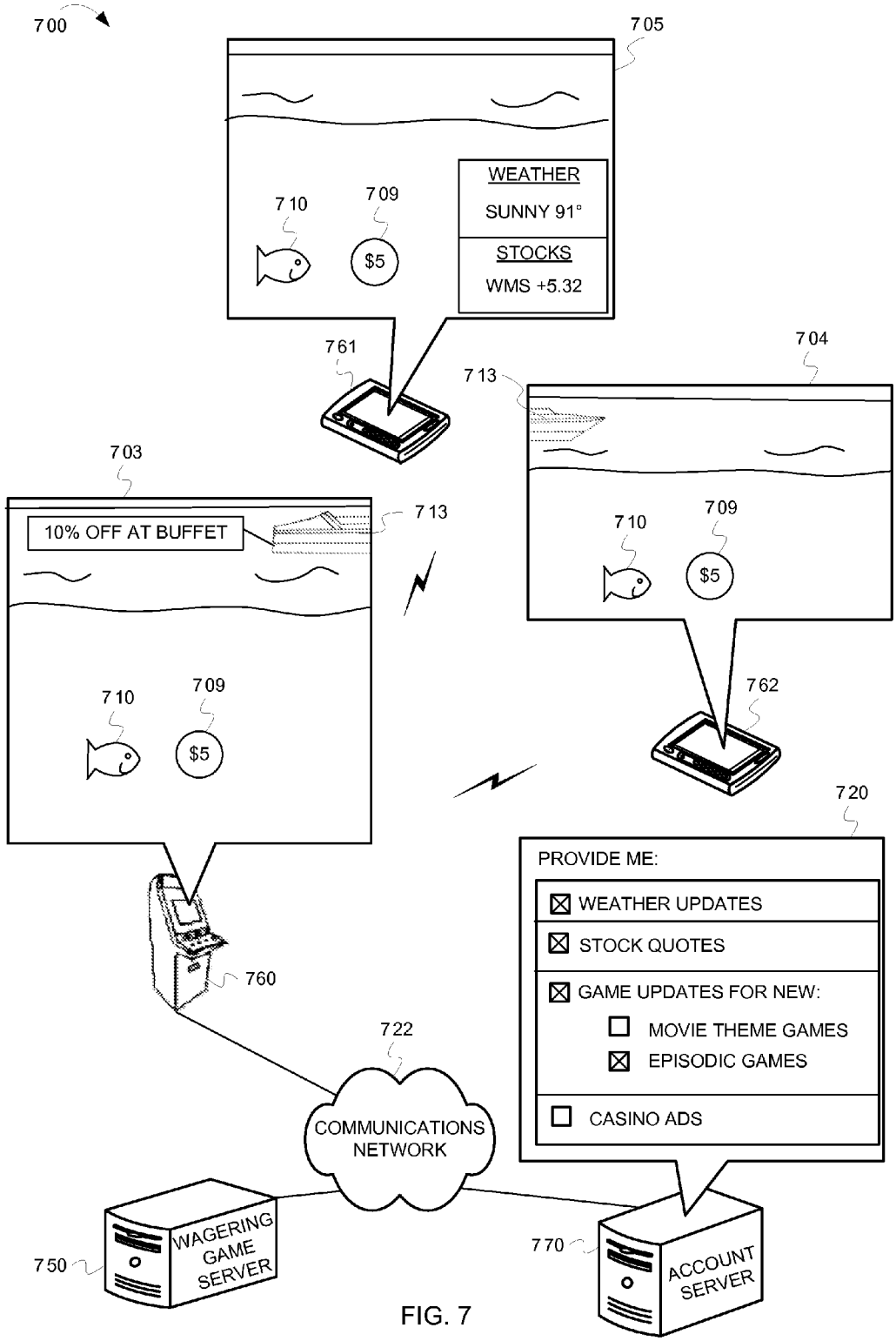
FIG. 7 is an illustration of coordinating wagering game content and network communications via a casino mesh network, according to some embodiments.

In some embodiments, a wagering game system ("system") can track any number of wireless devices within a wagering boundary so that the system can best determine when to perform activities, to ascertain community game rules and odds, to determine mesh network communication patterns, etc. FIGS. 2 and 3 illustrate examples of tracking wagering devices inside and outside of a wagering boundary. In some embodiments, the system can incentivize players to encourage other players to participate in the mesh network, thus increasing the efficiency of the mesh network. FIGS. 4 and 5 illustrate examples of incentivizing players using rewards. In some embodiments, the system can utilize wireless-enabled gaming machines within the wireless network to coordinate the presentation of wagering game content, wagering game player ("player") account information, and other casino network data. FIGS. 6 and 7 illustrate examples of sharing, and coordinating, the presentation of wagering game content between multiple mesh-enabled wagering machines.

These and other features are described in greater detail in the following sections.

Example Operating Environments

This section describes example operating environments and networks and presents structural aspects of some embodiments.

Figure 1:
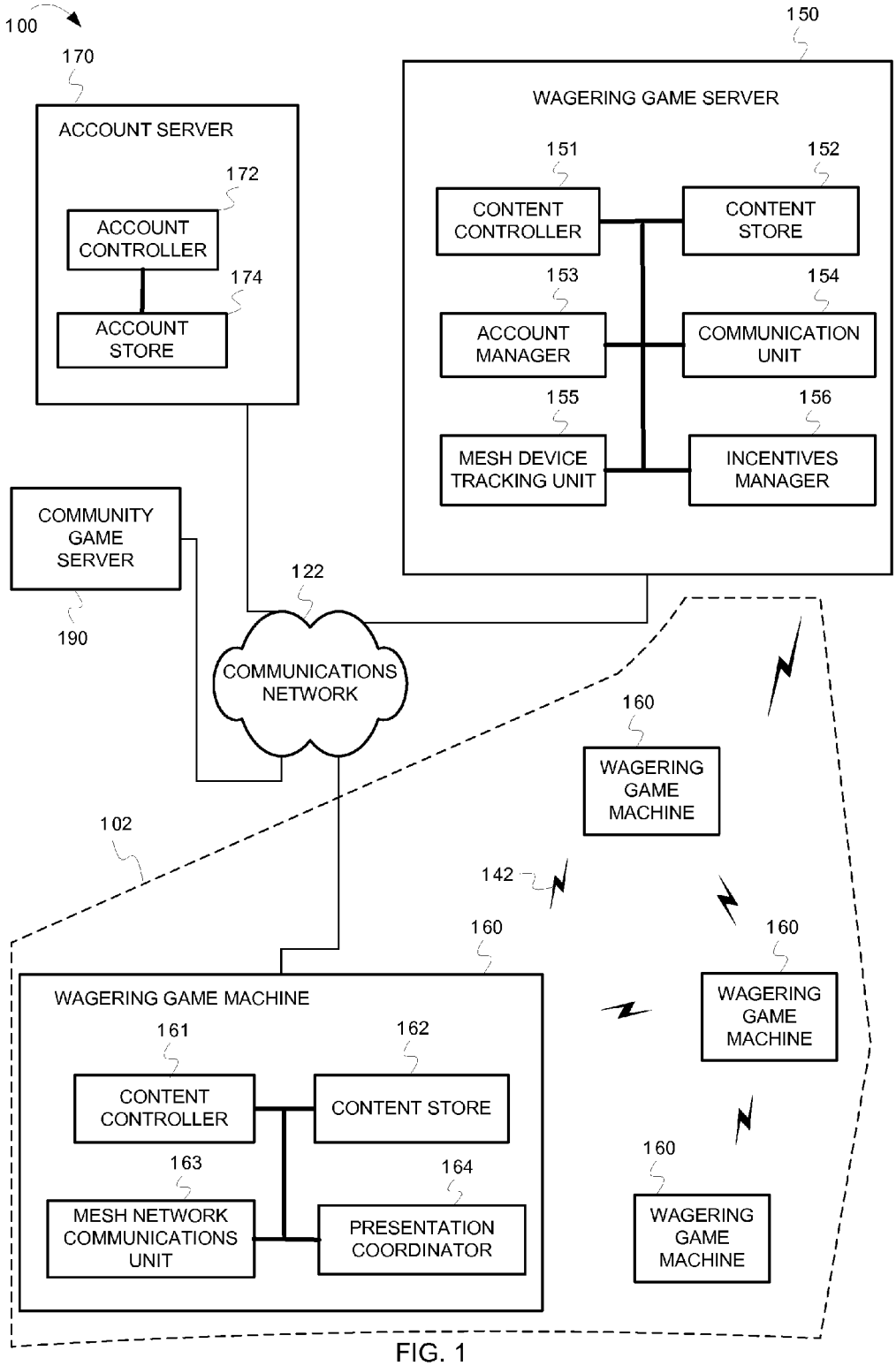
FIG. 1 is an illustration of a wagering game system architecture 100, according to some embodiments.

FIG. 1 is a conceptual diagram that illustrates an example of a wagering game system architecture 100, according to some embodiments. The wagering game system architecture 100 can include an account server 170, a wagering game server 150, a community game server 190, and multiple wagering game machines 160. The wagering game machines 160 have wireless communication capabilities. They can communicate with each other to form a mesh network 102. Some wagering game machines 160 can be connected directly to a communications network 122 via wires while others can be disconnected from the wired communication network 122 and can communicate exclusively via wireless signals 142. Each of the wagering game machines 160 can also communicate with other gaming devices (e.g., the wagering game server 150, the account server 170, the community game server 190, floor controllers, mesh routers, etc.) that have been equipped with, or converted to be, mesh-enabled devices. In some embodiments, the other gaming devices can be converted to mesh-enabled gaming devices by receiving mesh-enabling software that enables the other gaming devices to operate as mesh clients and/or a mesh routers, such as by having the ability to assign a "time to live" (TTL) value to data packets communicated to peer mesh devices. TTL is a protocol that can be used whereby each time a packet, or a copy of the packet, moves to another mesh network component, the packet's TTL value is decremented. The mesh network components may drop packets that have a TTL of zero. In other embodiments, the other gaming devices can be converted to mesh-enabled gaming devices by integrating a separate mesh-enabled device. As a result, mesh network components can wirelessly relay data to a final destination. In some embodiments, as more wireless devices are added to the mesh network 102, the network's bandwidth increases. The wagering game machines 160 and other gaming devices with wireless capabilities may be collectively referred to as "wireless" devices or "mesh" devices.

In some embodiments, the wireless devices can use different radio technologies including directional and smart antennas, MIMO systems, multi-radio systems, multi-channel systems, reconfigurable radios, frequency agile/cognitive radios, software radios, etc. In some embodiments, the wireless devices use low-power radio frequency signals 142 for transmitting data to other wireless devices. In some embodiments, the low-power signals 142 can only reach devices within a set range (e.g., neighboring devices). In some embodiments, certain devices can use one frequency, while other devices use another frequency. In some embodiments, the wireless devices can use optical signals, such as infrared signals, for transmitting data to other wireless devices.

The mesh network 102, according to some embodiments, can augment the abilities of the wired communications network 122. For example, in some embodiments, the mesh network 102 can work with the wired communications network 122 to increase network bandwidth and data transfer speeds. The mesh network 102 can reduce burdens on services (e.g., reduce data transfer caps on the wagering game server 150) to provide data to multiple clients (e.g., the wagering game machines 160). Instead the wagering game machines 160 can be configured with a data transfer service that uses nearby peers to supplement the data coming from the download server (e.g., the wagering game server 150). The wagering game server 150, and/or a nearby mesh device, can notify any of the wagering game machines 160 of an upcoming data transfer. The wagering game machines 160 can then look to the neighboring peers for the data. In some embodiments, the wagering game server 150 can delegate data transfer responsibilities to one of the wagering game machines 160 that is connected to the wired communications network 122 (thus allowing data to transfer very quickly and securely), but that also has wireless capabilities to transfer data to nearby wagering game machines 160. Each of the wagering game machines 160 thus becomes a wireless repeater with knowledge to route to nearby peers to circumvent the need for creating a traditional access point. Instead, the casino network can have arbitrary roaming access points.

In some embodiments, the mesh network 102 can access player account information from the account server 170 and utilize the information to manage network games and to present wagering game content according to player preferences. The account server 170 can be configured to control user related accounts accessible via wagering game networks and social networks. The account server 170 can store and track player information, such as identifying information (e.g., avatars, screen name, account identification numbers, etc.) or other information like financial account information, contact information, demographic information, etc. The account server 170 can contain accounts for social contacts referenced by the player account. The account server 170 can also provide auditing capabilities, according to regulatory rules, and track the performance of players, machines, and servers. The account server 170 can include an account controller 172 configured to control information for a player's account. The account server 170 also can include an account store 174 configured to store information for the player's account.

The wagering game server 150 can be configured to control wagering game content and communicate wagering game information, account information, and wagering game information to and from one or more of the wagering game machines 160. The wagering game server 150 can include a content controller 151 configured to manage and control content for the presentation of content on the wagering game machines 160. For example, the content controller 151 can generate game results (e.g., win/loss values), including win amounts, for games played on the wagering game machines 160. The content controller 151 can communicate the game results to the wagering game machines 160. The content controller 151 can also generate random numbers and provide them to the wagering game machines 160 so that the wagering game machines 160 can generate game results. The content controller 151 can also schedule installations of new games, broadcast network communications regarding game content, determine secure (e.g., via the wired communication network 122) versus non-secure communications (e.g., via the wireless mesh network 102), and control any other content related issue on the casino network. The content controller 151 can also delegate control to any of the wagering game machines 160, which can then coordinate mesh network communications and content amongst other wagering game machines. The wagering game server 150 also can include a content store 152 configured to contain content to present on the wagering game machines 160. The wagering game server 150 also can include an account manager 153 configured to control information related to player accounts. For example, the account manager 153 can communicate wager amounts, game results amounts (e.g., win amounts), bonus game amounts, etc., to the account server 170. The wagering game server 150 also can include a communication unit 154 configured to communicate information to the wagering game machines 160 and to communicate with other systems, devices and networks. The communication unit 154 can also obtain account information to present on mesh devices. The wagering game server 150 also can include a mesh device tracking unit 155 configured to track any number of mesh devices coming into and out of a wagering boundary. The mesh device tracking unit 155 can use tracking information to calculate odds on community games, schedule presentation of new games, etc. The wagering game server 150 also can include an incentives manager 156 configured to track efficiencies and beneficial effects caused by the mesh network 102 and present incentives for using and augmenting a mesh network user base.

The wagering game machines 160 can include a content controller 161 configured to manage and control content and presentation of content. The wagering game machines 160 also can include a content store 162 configured to contain content to present during a wagering game session. The wagering game machines 160 also can include a mesh network communications unit 163 configured to communicate with peer mesh network devices. The wagering game machine 160 also can include a presentation coordinator 164 configured to prioritize and present wagering game content and player requested content in a prioritized order based on mesh communications, schedulers, agents, local coordinators, and other information from devices on the network (e.g., from the wagering game server 150, from the community game server 190, from the account server 170, etc.).

The wagering game system architecture 100 also can include a community game server 190 configured to provide wagering game content for community games (e.g., progressive jackpot bonus games, sweepstakes, raffles, group board games, bingo, etc.). In some embodiments, the wagering game server 150 may also provide and/or control community games in conjunction with, or in place of, the community game server 190.

Each component shown in the wagering game system architecture 100 is shown as a separate and distinct element. However, some functions performed by one component could be performed by other components. For example, the mesh device tracking unit 155, like the content controller 151, can also schedule installations of new games, broadcast network communications regarding game content, determine secure versus non-secure communications, and control content related issue on the casino network as they relate to tracked mesh devices. Furthermore, the components shown may all be contained in one device, but some, or all, may be included in, or performed by multiple devices, as in the configurations shown in FIG. 1 or other configurations not shown. Furthermore, the wagering game system architecture 100 can be implemented as software, hardware, any combination thereof, or other forms of embodiments not listed. For example, any of the network components (e.g., the wagering game machines 160, servers 150, 170, 190, etc.) can include hardware and machine-readable media including instructions for performing the operations described herein. Machine-readable media includes any mechanism that provides (i.e., stores and/or transmits) information in a form readable by a machine (e.g., a wagering game machine, a computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Although FIG. 1 describes some embodiments, the following sections describe many other features and embodiments.

Example Operations

This section describes operations associated with some embodiments. In the discussion below, some flow diagrams are described with reference to block diagrams presented herein. However, in some embodiments, the operations can be performed by logic not described in the block diagrams.

In certain embodiments, the operations can be performed by executing instructions residing on machine-readable media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform more or less than all the operations shown in any flow diagram.

FIG. 2 is a flow diagram illustrating tracking wagering game devices inside and outside a wagering boundary using a mesh network, according to some embodiments. FIG. 3 is a conceptual diagram that helps illustrate the flow of FIG. 2, according to some embodiments. This description will present FIG. 2 in concert with FIG. 3. In FIG. 2, the flow 200 begins at processing block 202, where a wagering game system ("system") queries devices in a mesh network for location information of mobile wagering game machines ("mobile machines"). The location information can include the physical location of the mobile machines within the casino's physical property and the direction of movement that the mobile machines are moving. The system can use the location information to manage games and devices more efficiently (e.g., determine which devices should receive game assets before others, determine what players are interested in community games, etc.) In some embodiments, the system can use the information to determine whether wagering game machines devices are located inside or outside of a wagering boundary. FIG. 3 illustrates an example. In FIG. 3, a wagering game system ("system") 300 includes several devices connected to a communications network 322, including a wagering game server 350, an account server 370, a wireless floor controller device 306, and standing model ("non-mobile") wagering game machines 360, 361 ("non-mobile machines 360, 361"). The wagering game server 350 can communicate data to the non-mobile machines 360, 361 via wires (e.g., cables, Ethernet cords, etc.) in a communications network 322. The wagering game server 350 can also wirelessly communicate data to mobile wagering game machines 362, 363, 364, 365, 366, 367, 368, and 369 ("mobile machines 362-369") via the wireless floor controller device 306 and via the non-mobile machines 360, 361. In some embodiments, all of the wagering game machines 360-369 have wireless capabilities. The wagering game server 350 can delegate to some wagering game machines (e.g., the non-mobile machines 360, 361) the responsibility of coordinating the transfer of wagering game content, control information, and other wagering game related information to any of the mobile machines 362-369 within the system 300 that are within a wireless transmission range. The wagering game machines 360-369 can wirelessly transfer and receive data from their neighboring devices, forming a wireless mesh network 302. Some wagering game machines 365, 366, 367, 368 and 369 ("external mobile machines 365-369") are outside of a wagering boundary 310. The wagering boundary 310 is a regulatory area (e.g., casino "floor") where wagering games are allowed to be played. The system 300 must monitor all of the mobile machines 362-369 to ensure that wagering game activity does not occur outside of the wagering boundary 310. In some embodiments, the wireless floor controller device 306 and, at the same time, the wagering game machines 360-369 themselves, monitor the wagering boundary 310.

The flow 200 continues at processing block 204, where the system receives location information from the mobile machines within the mesh network, both inside and outside of a wagering boundary. In FIG. 3, all mobile machines 362-369 report, via the mesh network 302, their location information to nearby peers until the wagering game server 350 receives that information. More specifically, the mobile machines 362-369 pass location information, via the mesh network 302, from peer to peer back to the wireless floor controller device 306 and/or the non-mobile machines 360, 361. In some embodiments, each of the mobile machines 362-369 has a location unit (e.g., see, for example, location unit 838 in FIG. 8) that can determine its physical location within the casino as well as its direction of movement in relation to the wagering boundary 310. The wireless floor controller device 306 and the non-mobile machines 360, 361 convey the location information to the wagering game server 350 directly through wires in the communications network 322.

The flow 200 continues at processing block 206, where the system determines player account settings for game preferences. The system determines player account settings in an effort to most efficiently disseminate wagering game data to wagering game machines that are controlled by wagering game players interested in playing those wagering games. For example, a player may have indicated in player account settings that the player is interested in playing a specific wagering game when it becomes available (e.g., as a new wagering game, as a game on a waiting list, etc.). In other examples the system controls community games that permit multiple players to play the same game at the same time. Some players may have indicated that they are interested in playing a community game (e.g., the player missed the start of a community game session and is waiting for the start of the next community game session). The system can determine which wagering game players are interested in playing upcoming games by reading player account settings for game preferences that the players have indicated regarding the community games. For example, in FIG. 3, a player profile 315 indicates some preferences regarding notifications and automatic registrations that the player wants for specific community games and types of games. In some embodiments, the player profile 315 can be part of a player account stored on the account server 370. As a result, the system 300 can look up player identification information from the player account and use it to determine which of the mobile machines 360-369 the player is logged in to. In other embodiments, the player profile 315 may be a temporary profile of preferences stored by the wagering game server 350. A player can create a temporary profile by signing up on a waiting list (e.g., at a kiosk, at wagering game machine docking station, on the wagering game machine itself, etc.) to play a game when it becomes available. The system 300 can wirelessly detect the mobile machine that the player is using and store an identifier for later reference. The system 300 can later use that identifier to locate the mobile machine belonging to the player.

The flow 200 continues at processing block 208, where the system provides notice of upcoming wagering game(s) to mobile machines used by player accounts interested in the upcoming wagering game(s). If the player account settings indicate that the player wants to be notified of upcoming wagering games, then the system can determine which machines are in use by those player accounts. The system can detect player credentials that a player used to log in to a wagering game machine. The system can compare the credentials to a list of player account information to identify the player, and the respective machine that the player is currently using. The system can then send a notification message to the wagering game machine(s) that the interested player(s) are using. In some embodiments, the system can send a notification to a mobile phone, an email account, etc., to notify the player of the upcoming game(s). The system can also provide a schedule of when an upcoming game(s) are going to start and/or be deployed on the network. The player can acknowledge the notification message. If the player is outside of the wagering boundary, the player can indicate that the player will return to the wagering boundary for the start/deploy of the upcoming game(s). For instance, in FIG. 3, a player utilizing mobile machine 365 may receive a notification, via the mesh network 302, of an upcoming game. The player can send a return message, via the mesh network 302, that the player will return to the wagering boundary 310.

The flow 200 continues at processing block 210, where the system determines, based on the location information and/or player acknowledgement, which mobile machines will be in the wagering boundary at the start of the upcoming wagering game(s). For example, in FIG. 3, the system 300 can track the position of some moving mobile machines (e.g., moving mobile machines 363, 365, 368, 369) as they moves toward, or away from, the wagering game boundary 310. A few of the moving mobile machines (e.g., incoming mobile machines 366, 368 and 369) are outside of the wagering game boundary 310, and may be utilized by players that have received the notification and have responded with a message or that have begun moving toward the wagering boundary to receive data for the upcoming wagering game(s). The system 300 can determine the direction of movement, the speed, the path that the device follows to return to the boundary, etc., to determine whether the incoming mobile machines 365, 368, and 369 will be within the wagering boundary in time to receive the deployed data for the upcoming wagering game(s). The system 300 can also track the movement of mobile machines (e.g., outgoing mobile machine 363), that appear to be moving beyond the wagering boundary 310. Thus, at any given moment, the system 300 can receive location information, acknowledgement information, etc., to determine how many eligible wagering game machines are, or will be, within the wagering boundary 310.

The flow 200 continues at processing block 212, where the system determines configuration details for the upcoming wagering game(s) based on the total estimated wagering game machine population that will be in the wagering boundary and participating in upcoming wagering game(s). By knowing how many wagering game machines will be within the wagering boundary, the system can determine a deployment schedule for wagering game data, such as a data transfer priority list for specific machines that are going to participate in the upcoming wagering game(s). The system can transmit wagering game data to those machines using the mesh network.

The flow 200 continues at processing block 214, where the system prepares the wagering game machines (both those inside the wagering boundary, and those outside the boundary that are approaching the boundary) controlled by interested player account, with game assets and configuration information for the upcoming wagering game(s). For example, in FIG. 3, the system 300 estimates that the incoming mobile machines 365, 368 and 369 will be within the wagering game boundary 310 in time for the upcoming wagering game(s). As a result, the wagering game server 350 can send wagering game data (e.g., game assets, control information, critical data, etc.), to the non-mobile machines 360, 361, and/or the wireless floor controller 306, which transfer the wagering game data through the mesh network 302, to the incoming mobile machines 365, 368, and 369. Some mobile machines (e.g., mobile machines 363, 364), and the non-mobile machine 361, are the closest peers to the incoming mobile machines 365, 368, and 369, and, therefore, can reach the respective incoming mobile machines 365, 368, and 369 with a wireless mesh signal. The closest peers (e.g., mobile machines 363, 364 and the non-mobile machine 361) transfer the wagering game data to the incoming mobile machines 365, 368, and 369 even before they enter the wagering boundary 310 so that the incoming mobile machines 365, 368, and 369 are ready to begin game play as soon as they enter the wagering boundary 310. The system 300 can prepare the incoming mobile machines 365, 368, and 369 while still preventing a player from accessing the wagering game content until after the incoming mobile machines 365, 368, and 369 are inside of the wagering boundary 310. Further, the wagering game server 350 can calculate wagering game odds, game settings, player messages, or any other game configuration data that may be dependent on the number of players for the upcoming wagering game. The system can also use that information to prepare coordination schedules for game data, to delegate coordination duties to specific non-mobile machines, etc.

The flow 200 continues at processing block 216, where the system provides non-wagering modes to mobile machines that are estimated to remain outside the wagering boundary. For example, for mobile machines that are not within the wagering boundary, the system can perform specific activities on, or for, those machines. For instance, the system can enable secure modes, power-saving modes, maintenance modes, non-wagering game modes, etc., on those mobile machines by sending commands that are passed by mesh peers until reaching the mobile machines outside of the wagering boundary. Consequently, the mobile machines outside of the wagering boundary, though they may be beyond the wireless range of a casino floor controller, can still communicate with each other, via the mesh network, allowing the wagering game server to maintain contact with, and manage, those mobile machines. For instance, in FIG. 3, the system 300 can estimate that some mobile machines 366, 367 are outside of the wagering boundary 310 for an extended period of time. The system 300 can then turn off the ability for those mobile machines 366, 367 to receive and play wagering games. The system 300 can provide non-wagering games to those mobile machines 366, 367. The system 300 can also, via the mesh network 302 reduce power usage for the mobile machines 366, 367 if they appear to be inactive.

FIG. 4 is a flow diagram illustrating incentivizing wagering game player accounts to utilize a mesh network, according to some embodiments. In FIG. 4, the flow 400 begins at processing block 402, where a wagering game system ("system") determines a number of user accounts a player account has recruited to access a casino mesh network. The mesh network can be more efficient when there are more mesh peers to act as wireless nodes. Therefore, the system rewards wagering game players for recruiting others to join the mesh network. In some embodiments, a wagering game player can directly invite another player to begin using any mesh-enabled device. In other embodiments, however, the mesh capabilities for some devices may only be available when playing certain types of games (e.g., the mesh devices may only activate their mesh wireless capabilities or activate their peer-to-peer data transfer services, when playing games from a specific manufacturer, group games, new games, etc.). In other embodiments, several mesh networks may be competing in a casino space (e.g., mesh network services provided by different manufacturer's devices), and the player may want to recruit other players into one of the mesh networks. As a result, the player may recruit other players to play those specific types of games, or use a specific mesh network, thus promoting the certain types of games and increasing the number of mesh network users for the specific mesh network. In FIG. 5 a wagering game system ("system") 500 includes a wagering game server 550 that provides wagering game content and control information to several wagering game machines 560, 561, 562 via a communications network 522. An account server 570 is also connected via the communications network 522. The wagering game machines 560, 561, 562 can communicate with each other via a mesh network 502. A wagering game machine 560 can present a player interface 504 which includes an invitation panel 510 that a player can use to invite social contacts (e.g., friends) to play wagering games that are available on the system 500. Some of those games may only be available on devices that participate in the mesh network 502. The social contacts can be stored in a player account hosted by the account server 570. In some embodiments, the system 500 can suggest to the player certain types of games that the social contacts like more than others, thus increasing the possibility that the invitation will result in a successful recruitment. The system 500 can track whether the recruitment effort was successful by monitoring the social contact's activities to determine whether the social contact logs on to a mesh enabled device (e.g., using a player identification card or login) and begins playing the specified game. The system 500 can also include an identifier for the player account on the invitation, such as a unique code that identifies the player account. The system 500 can include a code validation control, such as a code entry input field, so that the social contact, upon login, can enter the code or otherwise identify the player account. The system 500 can use the code to identify the player account that recruited the social contact and apply the recruitment reward to the player's account. In other embodiments, the invitation can include an "accept" button, where the social contact can accept the invitation from the player account. The system 500 can use the acceptance to credit the player account for the recruitment effort once the wagering game player logs in to a mesh device and/or plays the wagering game. In some embodiments, the system 500 can include controls that the player could use to offer incentives (e.g., a player purchased credit for a free game play, a promise to share a percentage of points earned, etc.) to the social contact if the contact accepts the invitation. The system 500 can debit the player incentives from the player's account and credit them to the social contact's account.

The flow 400 continues at processing block 404, where the system provides one or more wagering game related rewards for recruitment results. In FIG. 5, the system 500 can include a recruitment tracker meter 507, an incentives display 508 and a reward redemption panel 509. The recruitment tracker meter 507 can track how many user accounts the player has recruited in a specified time period. The incentives display 508 can display incentives, or rewards, available for recruiting users. In some embodiments, the incentives display 508 can be tied to the game(s) selected in the invitation panel 510. Certain games may offer higher incentives if they are new games (i.e., games that have been available for play for only a short amount of time) and/or games that a social contact may not have a history of playing, thus offering a higher incentive to compensate for a potentially higher degree of recruitment effort that may be needed to convince the social contact to play the new game. The reward redemption panel 509 can include controls that a player can use to redeem rewards that the player has earned.

The flow 400 continues at processing block 406, where the system presents one or more indicators on the effects generated by the recruitment results. The system can provide indicator graphics that show a correlation between the number of mesh users and the beneficial effects that the increase in mesh users has had on game access efficiency, potential awards, network speeds, efficiency of distribution of winning awards, jackpot and/or bonuses, etc. The system can present graphics showing the correlation. For instance, in FIG. 5, the player interface 504 presents a meter 505 showing a number of mesh users and a corresponding meter 506 showing game award potential. As the system 500 detects increases in mesh network users, it indicates the increases in the meter 505. Subsequently (or concurrently), the system 500 can show an increase in game award potential (e.g., increase in one or more possible jackpot amounts) on the meter 506. The meters 505 and 506 can include one or more goal markers 512 that visually indicate to a player a specific amount of mesh user recruits, game award potential, or other values. The player can set the goal markers 512 as a motivational threshold value player can strive to meet. The system 500 can detect when one of the meters 505 and 506 has reached a goal marker 512, and credit the player account with a commensurate reward. The player can negotiate higher awards based on higher goals. For example, the incentives display 508 may increase in correlation to the setting of the goal markers 512.

FIG. 6 is a flow diagram illustrating coordinating wagering game content and network communications via a casino mesh network, according to some embodiments. FIG. 7 is a conceptual diagram that helps illustrate the flow of FIG. 6, according to some embodiments. This description will present FIG. 6 in concert with FIG. 7. In FIG. 6, the flow 600 begins at processing block 602, where a wagering game machine detects a nearby mesh peer in a casino mesh network that needs wagering game content. The wagering game machine may receive a directive from a higher level controller to seek out mesh peers that don't have specific wagering game content and share that content with the mesh peers. Consequently, the wagering game machine may wirelessly query a nearby peer within wireless range to see if the peer has certain files (e.g., queries whether content file versions are up to date, queries whether files exist, queries whether files need replacement, etc.). The mesh peer can reply, also wirelessly, to the wagering game machine with the appropriate information.

The flow 600 continues at processing block 604, where the wagering game machine transfers wagering game content to the peer. If the peer requires the wagering game content, then the wagering game machine can transfer the wagering game content to the peer via the mesh network. The wagering game machine can then transfer the directive to the peer so that each mesh network device may eventually receive the same directive that the previous wagering game machine received—to query nearby peers and transfer wagering game content. The transfer of wagering game content can spread via the mesh network, improving download times, especially during mass data transfer periods. Further, the wagering game machines each act as wireless routers, passing data to each other. Consequently, servers share the burden with clients for transferring data, thus reducing the need to serialize or cap the transfer of data. The wagering game machines can be equipped with security features that encrypt data during the transfers so that the wagering game content is not compromised. In some embodiments, the wagering game machines may deny a transfer of data unless it originates from a specific type of wagering game machine (e.g., a designated wagering game machine manager, a floor administrator's mobile machine, etc.). FIG. 7 includes an example of a wagering game system ("system") 700 including a non-mobile machine 760 that transfers wagering game content to mesh devices (e.g., mobile machines 761, and 762). The non-mobile machine 760 is connected to a wagering game server 750 via a communications network 722. The non-mobile machine 760 can be equipped with a wireless network card (e.g., an 801.11g card) so that it can communicate with the mobile machines 761, 762, which may be moving around a casino floor. In turn, the mobile machines 761, 762 can also have a wireless network cards (e.g., 801.11g cards) so that they can communicate with the non-mobile machine 760, with each other, and with other machines at different parts of the casino floor. The non-mobile machine 760 and the mobile machines 761, 762 can be configured with a data transfer service that offers data transfer between peers for software and/or firmware packages. Some mesh devices, such as the non-mobile machine 760, might have greater processing abilities, and thus may be configured with functionality that coordinates the distribution of data between nearby peers to smooth or redistribute data transfers between peers. The non-mobile machine 760, therefore, can act as a sort of peer manager. The wagering game server 750 transfers the wagering game content to the non-mobile machine 760. The non-mobile machine 760 receives the content and queries the mobile machines 761, 762, to see if they have received the wagering game content. In some embodiments, the non-mobile machine 760 may receive a distribution schedule (e.g., as part of an initial mass data distribution broadcast) that includes identifiers of specific wagering game machines that should receive the content before others. For instance, if mobile machine 761 is being utilized by a player account that has indicated a desire to play the wagering game content, then, as part of the query, the non-mobile machine 760 can determine the identity of the mobile machine 761 and compare it to the distribution schedule to determine if the mobile machine 761 should receive the data. Other mobile machines (e.g., mobile machines 762) can wait in a queue to receive the wagering game content at a later time. The non-mobile machine 760 can store the wagering game content and forward it to the other mobile machines later. In some embodiments, the system 700 may utilize a selective or switched broadcast mechanism where if parts of the data broadcast are missing or corrupt, the data transfer service may request those parts at a later time, possibly once the initial broadcast has finished.

The flow 600 continues at processing block 606, where the wagering game machine coordinates the presentation of the wagering game content. For example, in some embodiments a server can synchronize the display of wagering game content with non-mobile and mobile machines that are playing the same community game. In a competitive situation, a player on a mobile machine could compete in a community game event that another player on a non-mobile gaming machine could access. A community game server can communicate to the mobile machines through non-mobile delegates (e.g., non-mobile machine to mobile machine) and/or through wireless communications on the mesh network (e.g., mobile machine to mobile machine) to synchronize audio and video to make a community game event game occur as quickly and smoothly on the mobile machines as on the non-mobile machines. Consequently, the community game server can avoid delays in timing that normally would occur if the mesh devices were communicating via a back-end wireless network instead of via a mesh network. The community game server can communicate the wagering game content, and other information, to wired, non-mobile machines and to mobile machines, so that the order in which the wagering game machines receive the data at approximately the same time. In examples of community games where there is interaction between players (e.g., players trying to reel in a fish), then the system can ensure that all players to get the same opportunity to reel in a bonus item. The system can also return wagering game responses from wagering game machines to the community game server in a similar, synchronized fashion. For instance, in some embodiments, the wagering game contents may give the appearance that what the player does affects the outcome of the game. If some players are using mobile machines to control a wagering game character, then the mobile machines can use the mesh network to communicate the control data with the community game server. The community game server can then receive the control data at approximately the same time it receives control data for non-mobile machines. The community game server can produce a display of the player characters showing synchronized actions so that all of the players get the feeling that their actions are doing something.

In some embodiments, the mesh peer machines can coordinate the information with each other in both synchronous and non-synchronous ways. In FIG. 7, the non-mobile machine 760 coordinates the presentation of graphics between itself and the two mobile machines 761, 762. The non-mobile machine 760 synchronizes some graphics, such as the fish 710 and the coin 709, to appear to move at the same time on all of the displays 703, 704, and 705 for each of the wagering game machines 760, 761, 762. However, the non-mobile machine 760 can also present some graphics, such as the graphic of a boat 713, to appear in a serialized pattern across its own display 703 and other displays (e.g., display 705) at different times. The boat 713 may be generated by the wagering game server 750, and provided to the non-mobile machine 760 with control information indicating that as the boat moves off of the display 703 for the non-mobile machine 760 it should begin to appear on the displays of other machines (e.g., display 704 of the mobile machine 762) that are geographically situated next to the non-mobile machine 760. In other words, the control information attempts to make the boat 713 appear that it is moving in a single direction across a bank of wagering game machine displays in a coordinated manner. The non-mobile machine 760 determines the location of mobile wagering game machines 761 and 762 and recognizes that those machines are in the virtual path of the direction that the boat 713 travels, based on the control information. The non-mobile machine 760, therefore, presents the boat 713 across its own display 703, and as the boat begins to reach the edge of the display 703, the non-mobile machine 760 and the mobile machine 762 coordinate control information to make the boat 713 appear to move onto the display 704 of mobile machine 762. The non-mobile machine 760 also coordinates with the mobile machine 761, but the mobile machine 761 has a restricting player account setting associated with a player account 720 that is using the mobile machine 761. In the player account 720, several player preferences indicate information that a player desires to receive during a wagering game session. One of those preferences includes a setting that restricts the viewing of casino advertisements. The boat 713 may be a casino advertisement, and the non-mobile machine 760 accesses the player account 720 and determines that the boat 713 should not be displayed on the display 705 of the mobile machine 761. In other embodiments, however, the system 700 may not permit the restriction of casino advertisement as a player account setting, and would display the boat graphic on display 704 of mobile machine 761 in a coordinated fashion. When the boat 713 passes completely to the display 704 of the mobile machine 762, the non-mobile machine 760 can pass on the coordinating responsibility to the mobile machine 762 (or to another nearby non-mobile wagering game machine or other mesh device). The mobile machine 762 can then coordinate with its neighboring machines to propagate the movement of the boat 713 and coordinate its movement. The system 700 can present coordinated information other than, and in addition to, advertisements, such as congratulatory graphics, background theme graphics, network warnings or notices, game characters, bonus items, raffle drawing results, jackpot results, configuration data, etc.

The flow 600 continues at processing block 608, where the wagering game machine receives and transfers player account information for the mesh peer. The wagering game machine can determine whether certain player account data can be passed through the mesh network. The mesh network may have lower security settings than a wired network. As a result, the wagering game machine may receive data, or a request to transfer data, via the mesh network. If that data is critical or important enough to warrant extra security precautions during transfer, the wagering game machine may refuse to transfer the data, or encrypt it. Some critical data may include non-deterministic information that does not determine game play (e.g., some secondary graphics and sounds assets, instant messaging, stock tickers, etc.). Other data, such as some game assets (e.g., the ones that display critical information, wagers, financial information, etc.), may be sent over the wired network and/or have strong encryption over the mesh network. In FIG. 7, the player account 720 stored and/or hosted by an account server 770. The player account 720 may include preferences regarding information that the player using the mobile machine 761 would like to see during a wagering game session. The non-mobile machine 760 and/or the mobile machine 762, may receive some of the data described in the player account 720. The data may come from the player account 720 or may be pulled from other sources and sent, via the mesh network, to the mobile machine 761. The mobile machine 761 receives the player account information from its peers and displays the player account information on the display 705 of the mobile machine 761. Consequently, even though the mobile machine 762 and the non-mobile machine 760 may never use the player account information themselves, they can pass that player account information to the mobile machine 761 to use. The system 700 can remove the player account information from the mobile machine 762 and the non-mobile machine 760 as soon as it gets passed on. The account server 770 may include instructions, along with the player account information, that as soon as the player account information passes from a mesh device for which it was not to be displayed, then it should erase or encrypt itself to prevent from being compromised (e.g., hacked). Further, the account server 770 can encrypt the player account information and may include, with the player account information, a shared private key that is available only to the mobile machine 761 and the account server 770 so that the mobile machine 761 can decrypt the player account information once it receives it.

Additional Example Embodiments

According to some embodiments, a wagering game system ("system") can provide various example devices, operations, etc., to communicate wagering game information using mesh networks. The following non-exhaustive list enumerates some possible embodiments in addition to the embodiments already described above.

- A casino mesh network, wagering game device ("mesh device") can determine data from other mesh devices, and/or itself, that is not time sensitive (game play history, game meter storage, amounts won, some accounting information, etc.). The mesh device can store the data and later communicate the data to a server when bandwidth is high (e.g., a nightly batch process).
- A mesh device can broadcast advertising information, within a set range, to local mobile machines that may come near. The advertising information may advertise the merits of playing a game available only on the mesh device. The advertisements may also be for other games provided by a specific game manufacturer.
- A mesh device can broadcast game history to other mesh devices. Some examples of game history can include which games are getting more use, hitting more wins, etc. The mesh device can then offer to guide the player to a specific mesh device or present a specific wagering game that matches the game history.
- A mesh device can broadcast player information such as whether a hotel room is available, whether a specified tournament has an opening watched by player account, whether a new release of a game is available, etc.
- A mesh device can search for other mesh devices on the network that may have a hidden items (e.g., awards, activities, etc.), like in a scavenger hunt. The mesh device provides clues regarding the location of the hidden items. The mesh device can indicate "hot", "cold" and "warm" indicators of where the items are found within the mesh network. The mesh device can show maps. The hidden items can be part of a game theme (e.g., can hunt for Captain Kirk's communicator).
- A mesh device can be used to complete group activities. The mesh device can assist group members to communicate during the activities. For example, when communicating with a peer mesh device, the mesh devices may communicate directly (e.g., two-way radio communication, instant message, etc.) between only specified machines that belong to a group. Once a group task is completed, the mesh device communicates, through the mesh network, with a bank controller and the bank controller communicates, through the mesh, with another bank controller until determining a next task. The bank controllers then communicate back to the mesh device and indicate the new task.

A mesh device can receive a pool of tickets from a server. The server can push small pools, of a larger ticket pool, down to a mesh device as a peer manager. The peer manager mesh device can then coordinate with local peers as to who gets those tickets. In some embodiments, some peer managers may receive different overall prizes related to the tickets (e.g., a first peer manager is assigned a BMW as a prize for its ticket pool, where a second peer manager is assigned a Mercedes as a prize for its ticket pool). Some peer manager mesh devices may receive a very special ticket, like a "golden" ticket. That peer manager mesh device may randomly assign the golden ticket to a nearby peer. The golden ticket can appear as a game icon (e.g., a slot reel item), in a message, or some other way.

A mesh device can be used to broadcast messages across an entire casino, not just those tied to a small network or geographic location. The mesh device communications can cross over networks and reach remote areas that aren't on a wired casino network.

A mesh device can function as a publisher and/or a subscriber of data that publishes and/or subscribes to peers as well as to servers. A publisher has some data that a subscriber requests. Mesh peers can subscribe to a central service that the publishers register with. The mesh peers can then go to that service and ask for a list of publishers that publish the desired data. The subscribers and publishers can communicate in a variety of ways, for example, in a community game to communicate payout values, to publish new games, to invite players to play a game, to perform group activities, to join groups, to advertise casino content and/or activities, to resolve priority issues, to coordinate data, to store and forward data, to synchronize data, to resolve conflicts, etc.

A mesh device can carry and transmit data that is also sent through the wired casino network. This creates a data redundancy within the casino, resulting in higher reliability of data communication. The mesh device can ignore redundant messages that arrive later than others. The mesh device can transfer the redundant messages on different frequencies and/or channels, to see which one gets to its designated location first and/or for improved reliability. A mesh device can also transmit the same message on multiple channels at the same time.

A mesh device can implement its own network address translation and/or distribution. The mesh device can have the capability to provide an automated assignment of internet protocol (IP) addresses (e.g., via dynamic host configuration protocol or DHCP), which other mesh devices can utilize to communicate with. This can help to resolve internet protocol IP addresses across networks. The IP addresses on the mesh network, therefore, do not have to match like they would on a wired network. This can eliminate the need to map on the network.

Additional Example Operating Environments

This section describes example operating environments, systems and networks, and presents structural aspects of some embodiments.

Wagering Game Machine Architecture

Figure 8:
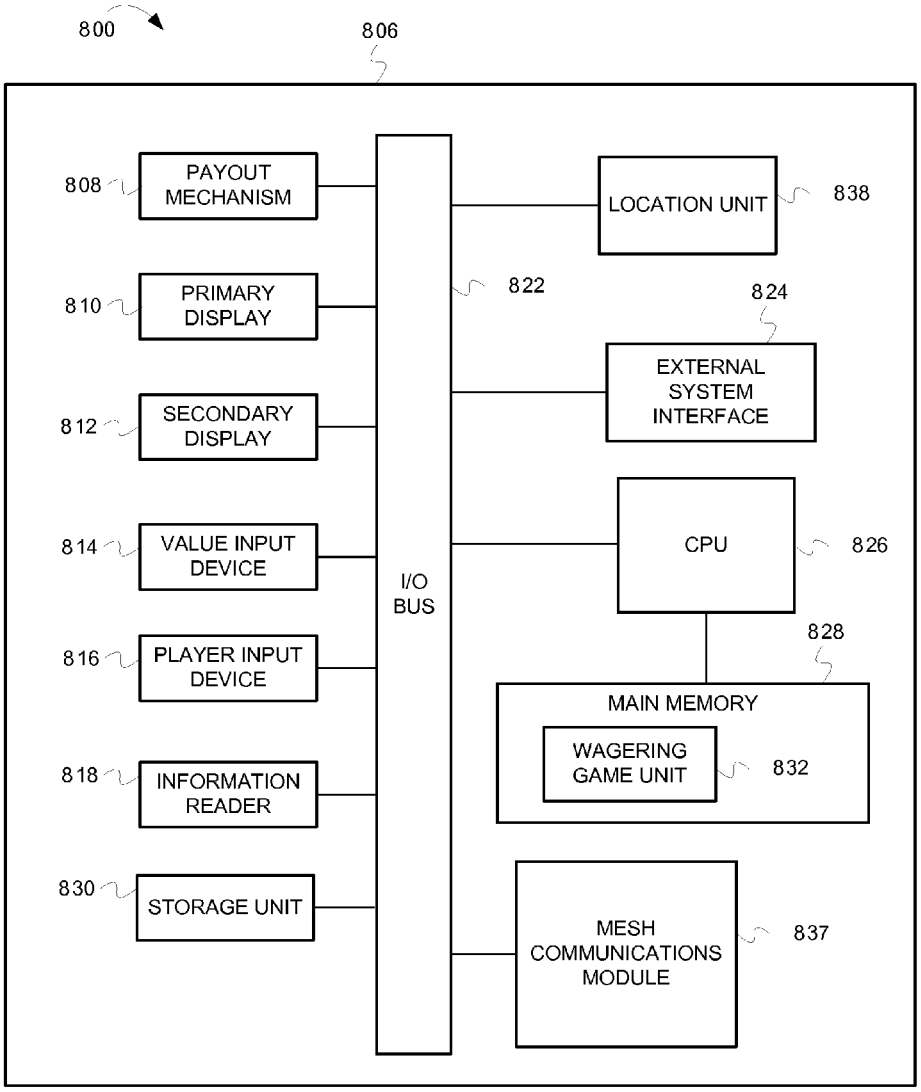
FIG. 8 is an illustration of a wagering game machine architecture 800, according to some embodiments.

FIG. 8 is a conceptual diagram that illustrates an example of a wagering game machine architecture 800, according to some embodiments. In FIG. 8, the wagering game machine architecture 800 includes a wagering game machine 806, which includes a central processing unit (CPU) 826 connected to main memory 828. The CPU 826 can include any suitable processor, such as an Intel® Pentium processor, Intel® Core 2 Duo processor, AMD Opteron™ processor, or UltraSPARC processor. The main memory 828 includes a wagering game unit 832. In some embodiments, the wagering game unit 832 can present wagering games, such as video poker, video black jack, video slots, video lottery, reel slots, etc., in whole or part.

The CPU 826 is also connected to an input/output ("I/O") bus 822, which can include any suitable bus technologies, such as an AGTL+frontside bus and a PCI backside bus. The I/O bus 822 is connected to a payout mechanism 808, primary display 810, secondary display 812, value input device 814, player input device 816, information reader 818, and storage unit 830. The player input device 816 can include the value input device 814 to the extent the player input device 816 is used to place wagers. The I/O bus 822 is also connected to an external system interface 824, which is connected to external systems 804 (e.g., wagering game networks). The external system interface 824 can include logic for exchanging information over wired and wireless networks (e.g., 802.11g transceiver, Bluetooth transceiver, Ethernet transceiver, etc.)

The I/O bus 822 is also connected to a location unit 838. The location unit 838 can create player information that indicates the wagering game machine's location/movements in a casino. In some embodiments, the location unit 838 includes a global positioning system (GPS) receiver that can determine the wagering game machine's location using GPS satellites. In other embodiments, the location unit 838 can include a radio frequency identification (RFID) tag that can determine the wagering game machine's location using RFID readers positioned throughout a casino. Some embodiments can use GPS receiver and RFID tags in combination, while other embodiments can use other suitable methods for determining the wagering game machine's location. Although not shown in FIG. 8, in some embodiments, the location unit 838 is not connected to the I/O bus 822.

In some embodiments, the wagering game machine 806 can include additional peripheral devices and/or more than one of each component shown in FIG. 8. For example, in some embodiments, the wagering game machine 806 can include multiple external system interfaces 824 and/or multiple CPUs 826. In some embodiments, any of the components can be integrated or subdivided.

In some embodiments, the wagering game machine 806 includes a mesh communications module 837. The mesh communications module 837 can process communications, commands, or other information, where the processing can communicate wagering game information using mesh networks.

Furthermore, any component of the wagering game machine 806 can include hardware, firmware, and/or machine-readable media including instructions for performing the operations described herein.

Mobile Wagering Game Machine

Figure 9:
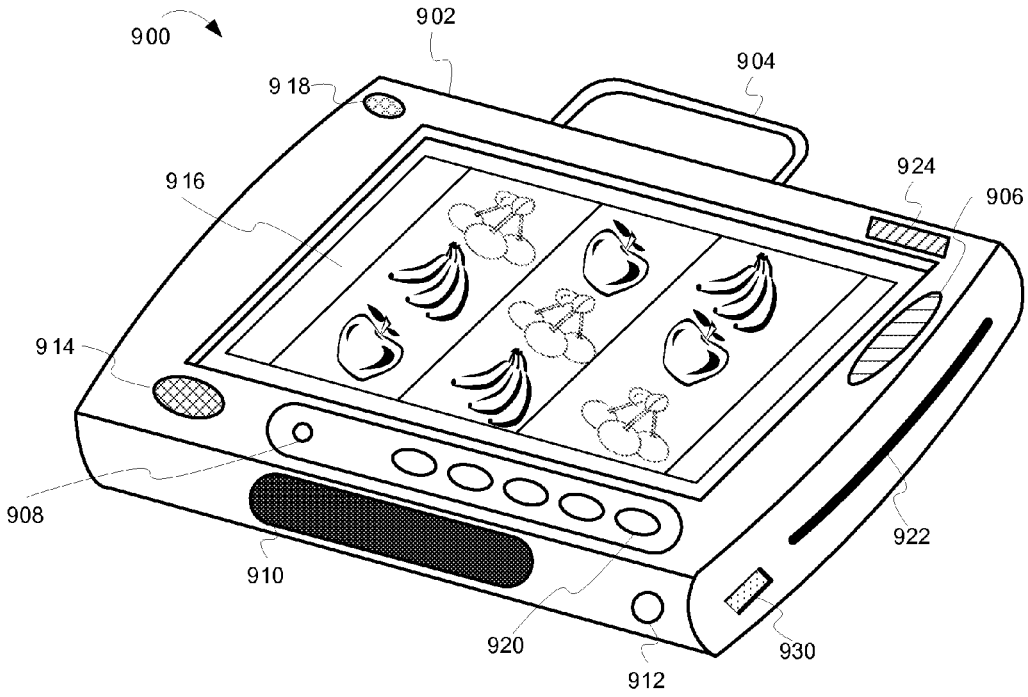
FIG. 9 is an illustration of a mobile wagering game machine 900, according to some embodiments.

FIG. 9 is a conceptual diagram that illustrates an example of a mobile wagering game machine 900, according to some embodiments. In FIG. 9, the mobile wagering game machine 900 includes a housing 902 for containing internal hardware and/or software such as that described above vis-à-vis FIG. 8. In some embodiments, the housing has a form factor similar to a tablet PC, while other embodiments have different form factors. For example, the mobile wagering game machine 900 can exhibit smaller form factors, similar to those associated with personal digital assistants. In some embodiments, a handle 904 is attached to the housing 902. Additionally, the housing can store a foldout stand 910, which can hold the mobile wagering game machine 900 upright or semi-upright on a table or other flat surface.

The mobile wagering game machine 900 includes several input/output devices. In particular, the mobile wagering game machine 900 includes buttons 920, audio jack 908, speaker 914, display 916, biometric device 906, wireless transmission devices 912 and 924, microphone 918, and card reader 922. Additionally, the mobile wagering game machine can include tilt, orientation, ambient light, or other environmental sensors.

In some embodiments, the mobile wagering game machine 900 uses the biometric device 906 for authenticating players, whereas it uses the display 916 and speakers 914 for presenting wagering game results and other information (e.g., credits, progressive jackpots, etc.). The mobile wagering game machine 900 can also present audio through the audio jack 908 or through a wireless link such as Bluetooth.

In some embodiments, the wireless communication unit 912 can include infrared wireless communications technology for receiving wagering game content while docked in a wager gaming station. The wireless communication unit 924 can include an 802.11G transceiver for connecting to and exchanging information with wireless access points. The wireless communication unit 924 can include a Bluetooth transceiver for exchanging information with other Bluetooth enabled devices.

In some embodiments, the mobile wagering game machine 900 is constructed from damage resistant materials, such as polymer plastics. Portions of the mobile wagering game machine 900 can be constructed from non-porous plastics which exhibit antimicrobial qualities. Also, the mobile wagering game machine 900 can be liquid resistant for easy cleaning and sanitization.

In some embodiments, the mobile wagering game machine 900 can also include an input/output ("I/O") port 930 for connecting directly to another device, such as to a peripheral device, a secondary mobile machine, etc. Furthermore, any component of the mobile wagering game machine 900 can include hardware, firmware, and/or machine-readable media including instructions for performing the operations described herein.

The described embodiments may be provided as a computer program product, or software, that may include a machine-readable medium having stored thereon instructions, which may be used to program a computer system (or other electronic device(s)) to perform a process according to embodiments(s), whether presently described or not, because every conceivable variation is not enumerated herein. A machine readable medium includes any mechanism for storing or transmitting information in a form (e.g., software, processing application) readable by a machine (e.g., a computer). The machine-readable medium may include, but is not limited to, magnetic storage medium (e.g., floppy diskette); optical storage medium (e.g., CD-ROM); magneto-optical storage medium; read only memory (ROM); random access memory (RAM); erasable programmable memory (e.g., EPROM and EEPROM); flash memory; or other types of medium suitable for storing electronic instructions. In addition, embodiments may be embodied in an electrical, optical, acoustical or other form of propagated signal (e.g., carrier waves, infrared signals, digital signals, etc.), or wireline, wireless, or other communications medium.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments, which are defined only by the appended claims. Each of the embodiments described herein are contemplated as falling within the inventive subject matter, which is set forth in the following claims.

The invention claimed is:

1. A computer-implemented method comprising:

detecting that a mobile wagering game machine is outside a wagering area of a casino, wherein the mobile wagering game machine is restricted from using wagering game content while outside the wagering area of the casino;

determining that the mobile wagering game machine is moving toward the wagering area of the casino before a scheduled time for a wagering game event conducted within the wagering area of the casino;

determining, based on movement of the mobile wagering game machine toward the wagering area of the casino, that the mobile wagering game machine will enter the wagering area of the casino before the scheduled time for the wagering game event; and coordinating a transfer of wagering game content for the wagering game event, via one or more peer devices in a casino mesh network, to the mobile wagering game machine before the mobile wagering game machine enters the wagering area of the casino, wherein the mobile wagering game machine is configured to use the wagering game content for the wagering game event after the mobile wagering game machine enters the wagering area.

2. The computer-implemented method of claim 1 further comprising:

detecting a setting for a player account assigned to the mobile wagering game machine, wherein the setting indicates that the player account is interested in participating in the wagering game event;

notifying the player account of the wagering game event, before the scheduled wagering game event begins, via the mobile wagering game machine, in response to detecting the setting;

detecting a response provided by the player account from the mobile wagering game machine in response to the notifying the player account; and assigning the player account to participate in the wagering game event before the mobile wagering game machine enters the wagering area of the casino.

3. The computer-implemented method of claim 1 further comprising:

providing an invitation to participate in the wagering game event from a first player account to the mobile wagering game machine, wherein the mobile wagering game machine is associated with a second player account;

detecting an acceptance of the invitation by the second player account from the mobile wagering game machine; and awarding a reward to the first player account when the mobile wagering game machine enters the wagering area of the casino based on the acceptance of the invitation.

4. The computer-implemented method of claim 1 further comprising:

determining an estimated number of wagering game machines that will be in the wagering area for the wagering game event based, at least in part, on the movement of the mobile wagering game machine toward the wagering area of the casino; and modifying a value of a reward for the wagering game event based on the estimated number of the wagering game machines.

5. The computer-implemented method of claim 1 further comprising:

coordinating transfer of a wagering game reward for the wagering game content for the wagering game event from a first of the one or more peer devices in the casino mesh network to the mobile wagering game machine before the mobile wagering game machine enters the wagering area of the casino;

detecting that the wagering game event begins after the mobile wagering game machine enters the wagering area of the casino; and coordinating transfer of the wagering game reward from the mobile wagering game machine to a second of the one or more peer devices in the casino mesh network during the wagering game event.

6. The computer-implemented method of claim 1 further comprising:

connecting the mobile wagering game machine to the one or more peer devices on the mesh network; and coordinating control of a group task for the wagering game event between the mobile wagering game machine and the one or more peer devices on the casino mesh network.

7. The computer-implemented method of claim 1 further comprising:

coordinating movement of a graphic associated with the wagering game event, via the casino mesh network, from a first display associated with the mobile wagering game machine to a second display associated with at least one of the one or more peer devices on the casino mesh network, wherein the coordinating the movement of the graphic causes a visual effect that shows the graphic moving concurrently off of the first display and onto the second display.

8. An apparatus comprising:

one or more processors; and one or more memory units configured to store instructions which, when executed by at least one of the one or more processors, causes the apparatus to receive wagering game content and coordination data from a wagering game server, store the wagering game content and the coordination data, determine that wagering game machines, enabled for mesh network communications, request the wagering game content, establish mesh network connections with the wagering game machines, transfer the wagering game content wirelessly to the wagering game machines via the mesh network connections in response to determination that the wagering game machines requested the wagering game content, and synchronize presentation of the wagering game content on the wagering game machines, via the mesh network connections, according to the coordination data.

9. The apparatus of claim 8, wherein the wagering game content is for a community wagering game, wherein the wagering game machines present the community wagering game, and wherein the instruction to synchronize the presentation of the wagering game content on the wagering game machines includes instructions which, when executed by at least one of the one or more processors, further cause the apparatus to cause the wagering game machines to present the wagering game content at approximately the same time.

10. The apparatus of claim 8, wherein the one or more memory units are configured to store instructions which, when executed by at least one of the one or more processors, further cause the apparatus to present secondary wagering game content in a serialized order via the wagering game machines.

11. The apparatus of claim 8, wherein the instructions, when executed by the at least one of the one or more processors, further cause the apparatus to transfer non-wagering game content indicated by a player account associated with the wagering game machines, and coordinate presentation of the non-wagering game content at the same time as presentation of the wagering game content.

12. The apparatus of claim 8, wherein the one or more memory units are configured to store instructions which, when executed by at least one of the one or more processors, further cause the apparatus to determine that one of the wagering game machines is associated with a player account preference for the wagering game content, and transfer the wagering game content to the one of the wagering game machines before transferring the wagering game content to a remainder of the wagering game machines that are not associated with the player account preference.

13. One or more non-transitory, machine-readable storage devices having instructions stored thereon, which when executed by a set of one or more processors causes the set of one or more processors to perform operations comprising:

detecting that a mobile wagering game machine is outside a wagering area of a casino, wherein the mobile wagering game machine is restricted from using wagering game content while outside the wagering area of the casino;

determining that the mobile wagering game machine is moving toward the wagering area of the casino before a scheduled time for a wagering game event conducted within the wagering area of the casino;

determining, based on movement of the mobile wagering game machine toward the wagering area of the casino, that the mobile wagering game machine will enter the wagering area of the casino before the scheduled time for the wagering game event; and coordinating a transfer of wagering game content for the wagering game event, via one or more peer devices in a casino mesh network, to the mobile wagering game machine before the mobile wagering game machine enters the wagering area of the casino, wherein the mobile wagering game machine is configured to use the wagering game content for the wagering game event after entering the wagering area of the casino.

14. The one or more non-transitory, machine readable storage media of claim 13, said operations further comprising:

detecting a setting for a player account assigned to the mobile wagering game machine, wherein the setting indicates that the player account is interested in participating in the wagering game event;

notifying the player account of the wagering game event, before the scheduled wagering game event begins, via the mobile wagering game machine, in response to detecting the setting;

detecting a response provided by the player account from the mobile wagering game machine in response to the notifying the player account; and assigning the player account to participate in the wagering game event before the mobile wagering game machine enters the wagering area of the casino.

15. The one or more non-transitory, machine readable storage media of claim 13, said operations further comprising:

providing an invitation to participate in the wagering game event from a first player account to the mobile wagering game machine, wherein the mobile wagering game machine is associated with a second player account;

detecting an acceptance of the invitation by the second player account from the mobile wagering game machine; and awarding a reward to the first player account when the mobile wagering game machine enters the wagering area of the casino based on the acceptance of the invitation.

16. The one or more non-transitory, machine readable storage media of claim 13, said operations further comprising:

determining an estimated number of wagering game machines that will be in the wagering area of the casino for the wagering game event based, at least in part, on the movement of the mobile wagering game machine toward the wagering area of the casino; and modifying a value of a reward for the wagering game event based on the estimated number of wagering game machines.

17. The one or more non-transitory, machine readable storage media of claim 13, said operations further comprising:

coordinating transfer of a wagering game reward for the wagering game content for the wagering game event from a first of the one or more peer devices in the casino mesh network to the mobile wagering game machine before the mobile wagering game machine enters the wagering area of the casino;

detecting that the wagering game event begins after the mobile wagering game machine enters the wagering area of the casino; and coordinating transfer of the wagering game reward from the mobile wagering game machine to a second of the one or more peer devices in the casino mesh network during the wagering game event.

18. The one or more non-transitory, machine readable storage media of claim 13, said operations further comprising:

connecting the mobile wagering game machine to the one or more peer devices on the mesh network; and coordinating control of a group task for the wagering game event between the mobile wagering game machine and the one or more peer devices on the casino mesh network.

19. The one or more non-transitory, machine readable storage media of claim 13, said operations further comprising:

coordinating movement of a graphic associated with the wagering game event, via the casino mesh network, from a first display associated with the mobile wagering game machine to a second display associated with at least one of the one or more peer devices on the casino mesh network, wherein the coordinating movement of the graphic causes a visual effect that shows the graphic moving concurrently off of the first display and onto the second display.

20. An apparatus comprising:

means for detecting that a mobile wagering game machine is outside a wagering area of a casino, wherein the mobile wagering game machine is restricted from using wagering game content while outside the wagering area of the casino;

means for determining that the mobile wagering game machine is moving toward the wagering area of the casino before a scheduled time for a wagering game event conducted within the wagering area of the casino;

means for determining, based on movement of the mobile wagering game machine toward the wagering area of the casino, that the mobile wagering game machine will enter the wagering area of the casino before the scheduled time for the wagering game event; and means for coordinating a transfer of wagering game content for the wagering game event, via one or more peer devices in a casino mesh network, to the mobile wagering game machine before the mobile wagering game machine enters the wagering area of the casino, wherein the mobile wagering game machine is configured to use the wagering game content for the wagering game event after entering the wagering area of the casino.

21. The apparatus of claim 20 further comprising:

means for detecting a setting for a player account assigned to the mobile wagering game machine, wherein the setting indicates that the player account is interested in participating in the wagering game event;

means for notifying the player account of the wagering game event, before the scheduled wagering game event beings, via the mobile wagering game machine, in response to detecting the setting;

means for detecting a response provided by the player account from the mobile wagering game machine in response to the notifying the player account; and means for assigning the player account to participate in the wagering game event before the mobile wagering game machine enters the wagering area of the casino.

22. The apparatus of claim 20 further comprising:

means for providing an invitation to participate in the wagering game event from a first player account to the mobile wagering game machine, wherein the mobile wagering game machine is associated with a second player account;

means for detecting an acceptance of the invitation by the second player account from the mobile wagering game machine; and means for awarding a reward to the first player account when the mobile wagering game machine enters the wagering area of the casino based on the acceptance of the invitation.

23. The apparatus of claim 20 further comprising:

means for determining an estimated number of wagering game machines that will be in the wagering area of the casino for the wagering game event based, at least in part, on the movement of the mobile wagering game machine toward the wagering area of the casino; and means for modifying a value of a reward for the wagering game event based on the estimated number of the wagering game machines.

24. The apparatus of claim 20 further comprising:

means for coordinating transfer of a wagering game reward for the wagering game content for the wagering game event from a first of the one or more peer devices in the casino mesh network to the mobile wagering game machine before the mobile wagering game machine enters the wagering area of the casino;

means for detecting that the wagering game event begins after the mobile wagering game machine enters the wagering area of the casino; and means for coordinating transfer of the wagering game reward from the mobile wagering game machine to a second of the one or more peer devices in the casino mesh network during the wagering game event.

25. The apparatus of claim 20 further comprising:

means for connecting the mobile wagering game machine to the one or more peer devices on the mesh network; and means for coordinating control of a group task for the wagering game event between the mobile wagering game machine and the one or more peer devices on the casino mesh network.

26. The apparatus of claim 20 further comprising:

means for coordinating movement of a graphic associated with the wagering game event, via the casino mesh network, from a first display associated with the mobile wagering game machine to a second display associated with at least one of the one or more peer devices on the casino mesh network, wherein the coordinating movement of the graphic causes a visual effect that shows the graphic moving concurrently off of the first display and onto the second display.

* * * * *